US007306424B2

(12) United States Patent
Romanov et al.

(10) Patent No.: US 7,306,424 B2
(45) Date of Patent: Dec. 11, 2007

(54) BLADE OUTER SEAL WITH MICRO AXIAL FLOW COOLING SYSTEM

(75) Inventors: Dmitriy Romanov, Wells, ME (US); Jeremy Drake, South Berwick, ME (US)

(73) Assignee: United Technologies Corporation, Hartford, CT (US)

( * ) Notice: Subject to any disclaimer, the term of this patent is extended or adjusted under 35 U.S.C. 154(b) by 148 days.

(21) Appl. No.: 11/025,172

(22) Filed: Dec. 29, 2004

(65) Prior Publication Data

US 2006/0140753 A1 Jun. 29, 2006

(51) Int. Cl.
*F01D 5/14* (2006.01)

(52) U.S. Cl. ..... 415/115; 415/116; 415/173.1
(58) Field of Classification Search ..... 415/115, 415/116, 173.1, 173.2
See application file for complete search history.

(56) References Cited

U.S. PATENT DOCUMENTS 4,573,866 A * 3/1986 Sandy et al. ..... 415/116
5,375,973 A * 12/1994 Sloop et al. ..... 415/173.1
5,486,090 A 1/1996 Thompson et al.
5,584,651 A * 12/1996 Pietraszkiewicz et al. .. 415/115
6,139,257 A * 10/2000 Proctor et al. ..... 415/115
6,368,054 B1 * 4/2002 Lucas ..... 415/135

* cited by examiner

*Primary Examiner*—Hoang Nguyen
(74) *Attorney, Agent, or Firm*—Carlson, Gaskey & Olds

(57) ABSTRACT

A turbine blade outer air seal assembly includes a hot side exposed to a combustion hot gas flow, and a back side that is exposed to a supply of cooling air. The outer air seal segment includes a trailing edge cavity and a leading edge cavity separated by a divider. The cavities are feed cooling air through a plurality of inlet openings disposed transverse to the gas flow. The cooling air enters the cavities and flows toward a plurality of outlets at the leading edge and a plurality of outlets along the trailing edge. A plurality of pedestals within each of the cavities disrupts cooling air flow to increase heat absorption capacity and to increase the surface area capable of transferring heat from the hot side.

22 Claims, 5 Drawing Sheets

BLADE OUTER SEAL WITH MICRO AXIAL FLOW COOLING SYSTEM

BACKGROUND OF THE INVENTION

This invention relates generally to a blade outer air seal for a gas turbine engine. More particularly, this invention relates to a blade outer air seal with improved cooling features.

A gas turbine engine includes a compressor, a combustor and a turbine. Compressed air is mixed with fuel in the combustor to generate an axial flow of hot gases. The hot gases flow through the turbine and against a plurality of turbine blades. The turbine blades transform the flow of hot gases into mechanical energy to rotate a rotor shaft that drives the compressor. A clearance between a tip of each turbine blade and an outer air seal is preferably controlled to minimize flow of hot gas therebetween. Hot gas flow between the turbine tip and outer air seal is not transformed into mechanical energy and therefore negatively affects overall engine performance. Accordingly, the clearance between the tip of the turbine blade and the outer air seal is closely controlled.

The outer air seal is exposed to the hot gases and therefore requires cooling. The outer air seal typically includes an internal chamber through which cooling air flows to control a temperature of the outer air seal. Cooling air is typically bleed off from other systems that in turn reduces the amount of energy that can be utilized for the primary purpose of providing thrust. Accordingly it is desirable to minimize the amount of air bleed off from other systems to perform cooling. Various methods of cooling the outer air seal are currently in use and include impingement cooling where cooling air is directed to strike a back side of an outer surface exposed to hot gases. Further, cooling holes are utilized to feed cooling air along an outer surface to generate a cooling film that protects the exposed surface. Each of these methods provides good results. However, improvements in gas turbine engines have resulted in increased temperatures and more extreme operating conditions for those parts exposed to the hot gas flow.

Accordingly, there is a need to design and develop a blade outer air seal that utilizes cooling air to the maximum efficiency to both increase cooling effectiveness and reduce the amount of cooling air required for cooling.

SUMMARY OF THE INVENTION

This invention is an outer air seal assembly for a turbine engine that includes a plurality of pedestals within two main cavities that produce a turbulent airflow and increase surface area resulting in an increase in cooling capacity for maintaining a hot side surface at a desired temperature.

The outer seal assembly includes a plurality of seal segments joined together to form .a shroud about a plurality of turbine blades. Each of the outer air seal segments includes the hot side exposed to the gas flow, and a back side that is exposed to a supply of cooling air. The outer air seal segment includes a leading edge, a trailing edge and two axial edges that are transverse to the leading and trailing edges. A trailing edge cavity and a leading edge cavity are separated within the seal segment. Cooling air introduced on the back side of the seal segment and enters each of the cavities to cool the hot side.

The cavities are feed cooling air through a plurality of inlet openings. The inlet openings are disposed transverse to the gas flow. Cooling air enters the cavities and flows toward a plurality of outlets at the leading edge and a plurality of outlets along the trailing edge. Cooling air also enters the cavities through a plurality of re-supply openings that introduce additional cooling air to local areas of the cavities for maximizing cooling and heat transfer functions.

The seal segment includes axial cavities disposed adjacent axial edges that provide cooling air flow to the axial edges for preventing hot gas from seeping between adjacent seal segments. The axial cavities include dividers to isolate cooling air flow from the other cavities.

The leading edge, trailing edge and axial cavities include a plurality of pedestals that disrupt and cooling air flow to increase heat absorption capacity and to increase the surface area capable of transferring heat from the hot side. Disruption of the cooling air flow creates desirable turbulent flow from the inlets to the outlets. Turbulent air flow provides an increased heat absorption capacity. Further, the increased surface area provided by the plurality of pedestals provides an increase in heat absorption capacity. The combination of increased turbulent flow and increased surface area increases the efficiency of the cooling features allowing less cooling air flow to be utilized to provide the desired cooling of the seal segment.

Accordingly, the blade outer air seal of this invention increase cooling air effectiveness providing for the decrease in cooling air required to maintain a desired temperature of an outer air seal.

These and other features of the present invention can be best understood from the following specification and drawings, the following of which is a brief description.

DETAILED DESCRIPTION OF THE PREFERRED EMBODIMENT

Figure 1:
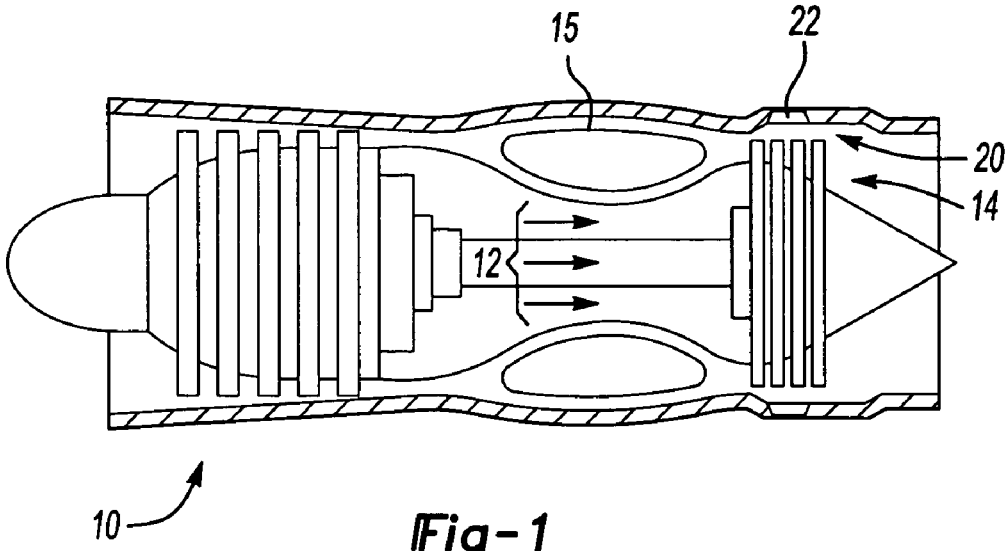
FIG. 1 is a schematic view of a turbine engine including a blade outer air seal according to this invention.
Figure 2:
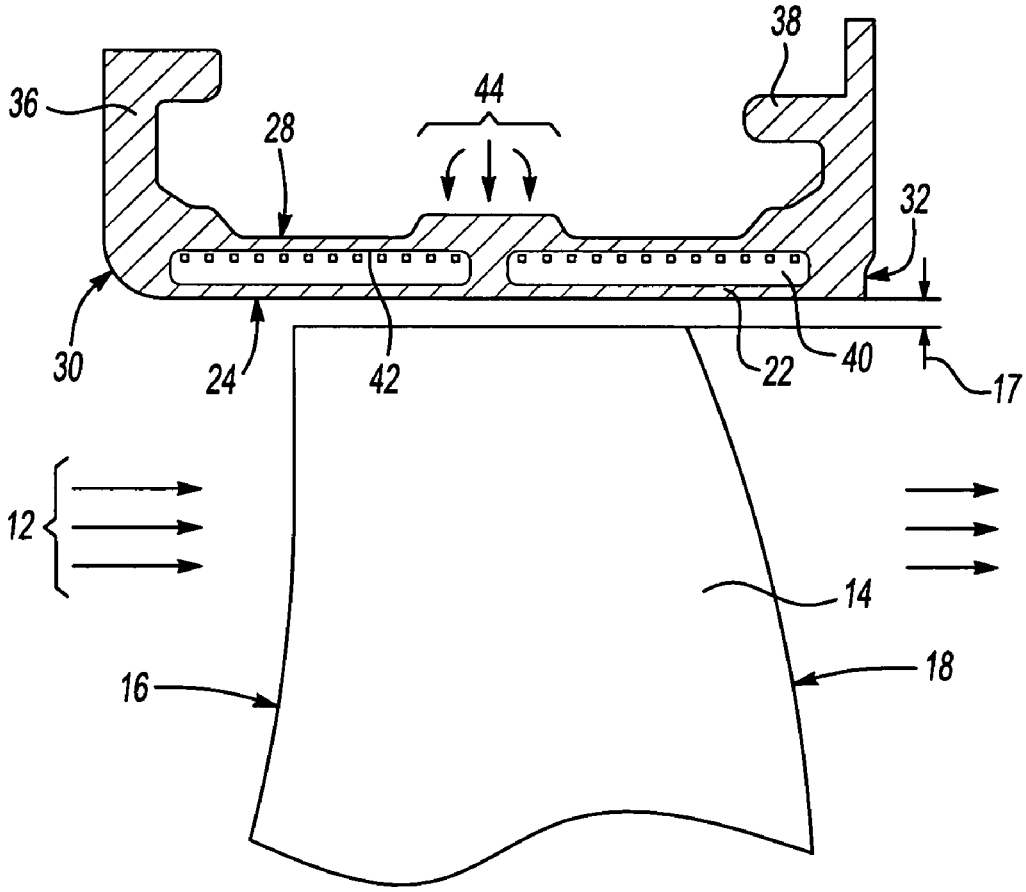
FIG. 2 is an enlarged sectional view of the turbine blade and blade outer air seal.

Referring to FIGS. 1 and 2, a turbine engine assembly 10 is partially and schematically shown and includes a turbine blade 14 for transforming energy from a hot combustion gas flow 12 into mechanical energy. The turbine blade 14 is an airfoil having a leading edge 16 and a trailing edge 18. Gas flow 12 is directed toward the turbine blade 14 by an exhaust liner assembly 15 as is known. The turbine blade 14 includes a tip edge 19 that is spaced apart from an outer air seal assembly 20. The outer air seal assembly 20 is spaced apart a desired clearance 17 to minimize gas flow 12 between the blade tip edge 19 and the outer air seal assembly 20. The outer air seal assembly 20 includes a plurality of outer air seal segments 22.

Referring to FIG. 2 the outer air seal segment 22 includes a hot side 24 that is exposed to the gas flow 12, and a back side 28 that is exposed to a supply of cooling air flow 44. The outer air seal segment 22 includes a leading edge 30, a trailing edge 32 and two axial edges 34 (FIG. 3) transverse to the leading and trailing edges 30,32. The seal segment 22 is mounted to a fixed structure of the engine assembly 10 by way of a front support leg 36 and a rear support leg 38. A trailing edge cavity 40 and a leading edge cavity 42 are disposed within the seal segment 22 between the hot side 24 and the back side 28. Cooling air flow 44 is introduced on the back side 28 of the seal segment 22 and enters each of the cavities 40,42 to cool the hot side 24.

Figure 3:
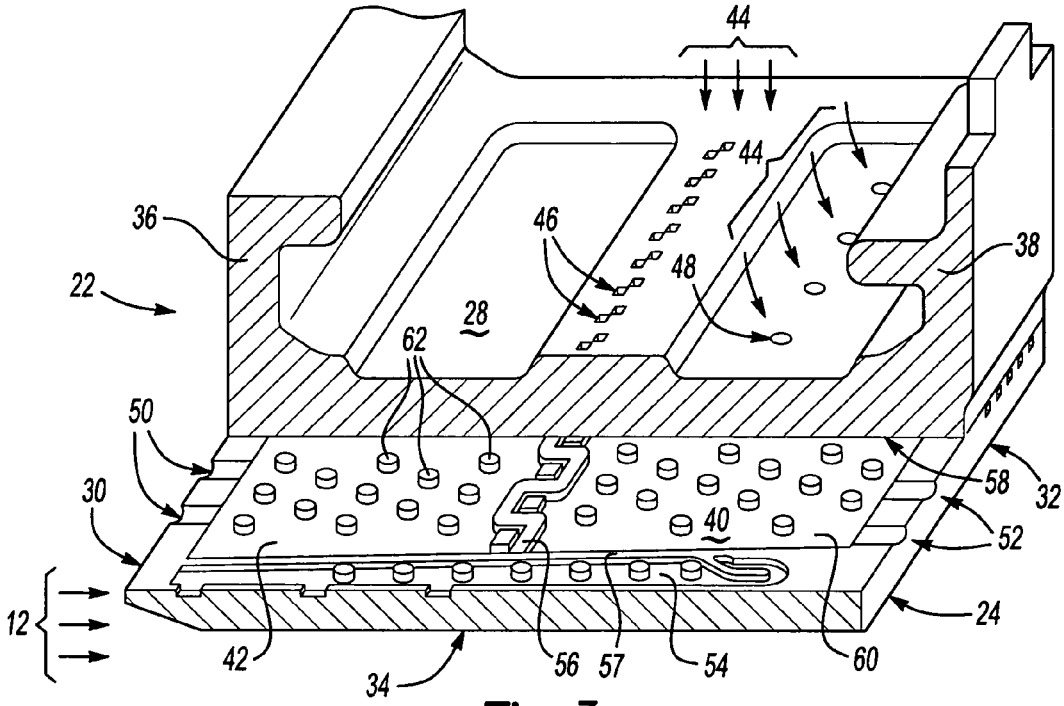
FIG. 3 is a partial sectional view of the blade outer air seal according to this invention.
Figure 4:
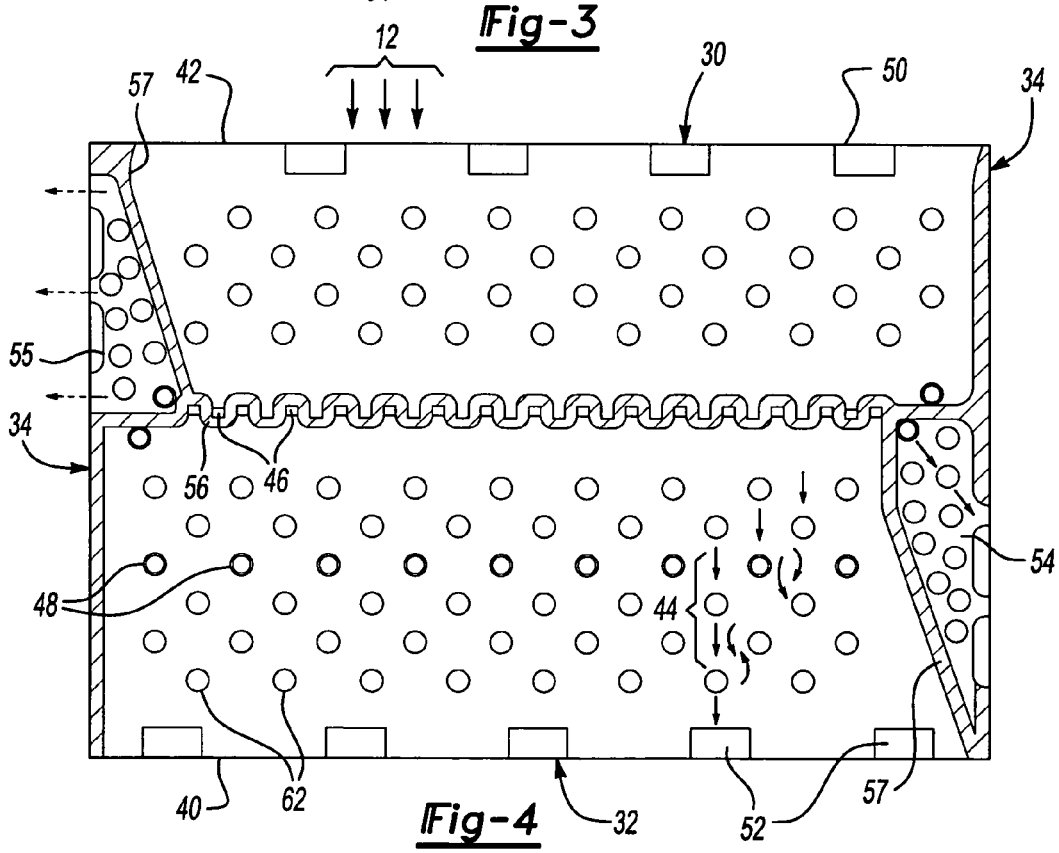
FIG. 4 is a cross-sectional view of the blade outer air seal according to this invention.

Referring to FIGS. 3 and 4, the cavities 40,42 receive cooling air flow 44 through a plurality of inlet openings 46. The inlet openings 46 are disposed transverse to the gas flow 12. The inlet openings 46 alternate the cavity 40,42 in which cooling air flow is communicated. A divider 56 provides for the division of cooling air between the leading edge cavity 42 and the trailing edge cavity 40. The divider 56 is structured such that adjacent inlet openings 46 supply cooling air to different cavities 40,42.

Cooling air flow 44 entering the cavities 40,42 flows toward a plurality of outlets 50 at the leading edge 30 and a plurality of outlets 52 along the trailing edge 32. Cooling air flow 44 also enters the cavities through a plurality of re-supply openings 48. The re-supply openings 48 introduce additional cooling air 44 to local areas of the cavities 40,42 to optimize cooling and heat transfer functions.

The seal segment 22 also includes axial cavities 54 and 55 disposed adjacent axial edges 34. The axial cavities 54, 55 provide cooling air flow 44 to the axial edges 34 to prevent hot gas 12 from seeping between adjacent seal segments 22. The axial cavities 54, 55 include dividers 57 to isolate cooling air flow 44 from the other cavities. The axial cavities 54,55 receive cooling air flow from a re-supply opening 48 in communication with only that cavity. FIG. 4 illustrates axial cavities 54 and 66 at opposite axial edges 34 and on the leading edge 30 and the trailing edge 32. This provides for control of heat build up and absorption at the axial edges 34 separate from that provided by the leading edge and trailing edge cavities 40,42.

Figure 5A:
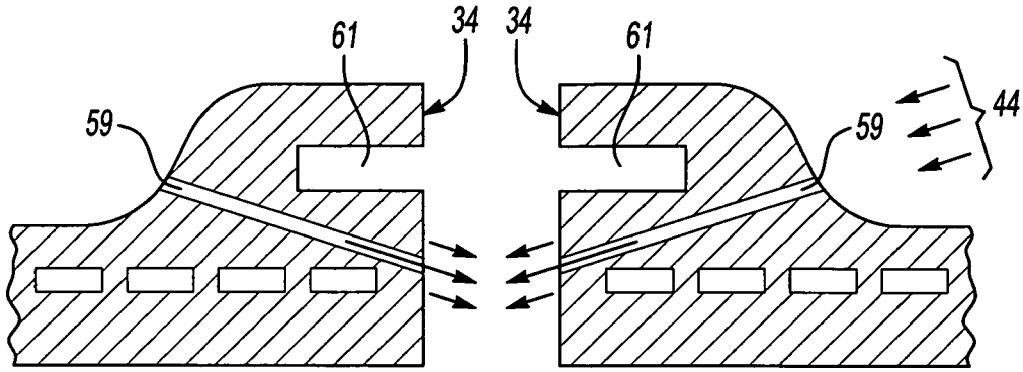
FIG. 5A is a cross-sectional view of an axial edge cooling feature according to this invention.

Referring to FIG. 5A another axial edge cooling configuration includes a groove 61 for accepting a seal (not shown). A passage 59 communicates cooling air 44 directly to the interface between adjacent seal segments 22. This provides for the cooling of the axial edge 34 and prevents intrusion of hot gases 12 between adjacent seal segments 22.

Figure 5B:
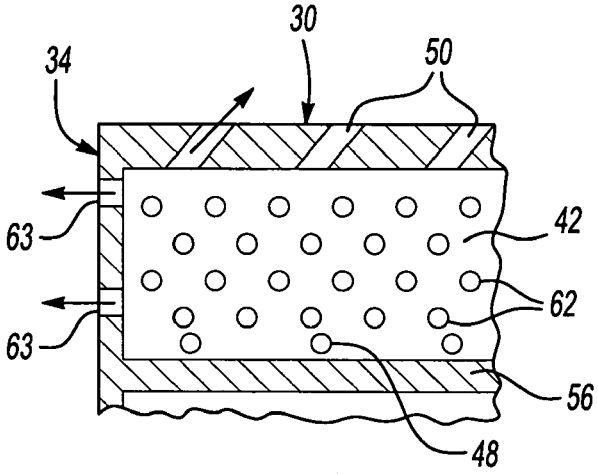
FIG. 5B is a cross-sectional view of another axial edge cooling feature according to this invention.

Referring to FIG. 5B another axial edge cooling configuration includes additional outlets 63 in communication with one of the leading edge or trailing edge cavities 40,42. The injection of cooling air flow 44 provides the desired cooling of the axial edges of each seal segment 22.

Referring to FIGS. 3 and 4, the leading edge, trailing edge and axial cavities 40,42, 54, all 55 include a plurality of pedestals 60 that disrupt cooling air flow 44 to increase heat absorption capacity and to increase the surface area capable of transferring heat from the hot side 24. The cavities 40,42, and 54 include a top surface 58 and a bottom surface 60. The bottom surface 60 is shown and includes the plurality of pedestals 62.

The pedestals 62 extend between the top surface 58 and the bottom surface 60 to form a honeycomb structure that creates a tortuous path for the cooling air flow 44. The pedestals 62 are cylindrical structures that disrupt the laminar flow of the cooling air flow 44. Disruption of the cooling air flow 44 creates desirable turbulent flow from the inlets 46 to the outlets 50,52. Turbulent air flow provides an increased heat absorption capacity. Further, the increased surface area provided by the plurality of pedestals 62 also provides an increase in heat absorption capacity. The combination of increased turbulent flow and increased surface area increases the efficiency of the cooling features allowing less cooling air flow to be utilized to provide the desired cooling of the seal segment 22.

Figure 6A:
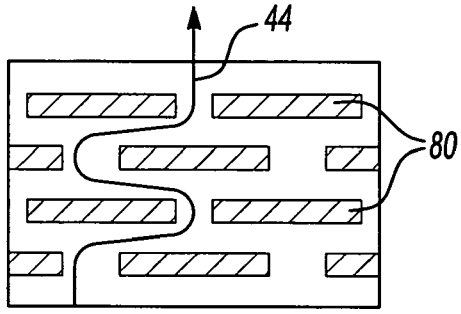
FIG. 6A is a schematic view of a pedestal according to this invention.
Figure 6B:
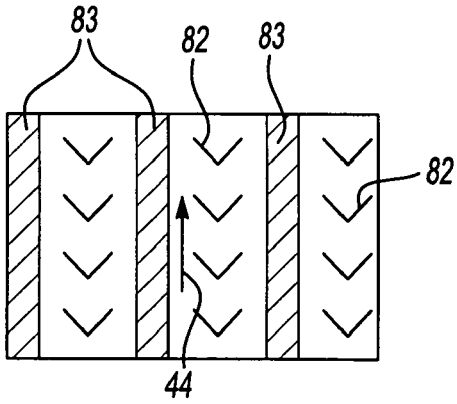
FIG. 6B is a schematic view of another pedestal according to this invention.
Figure 6C:
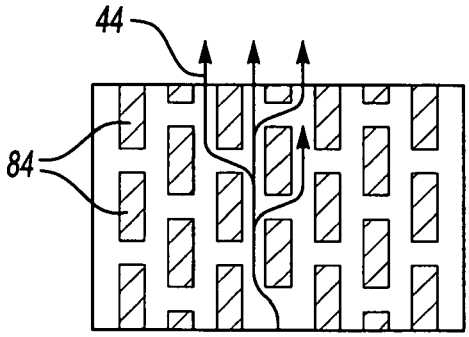
FIG. 6C is schematic view of another pedestal according to this invention.
Figure 6D:
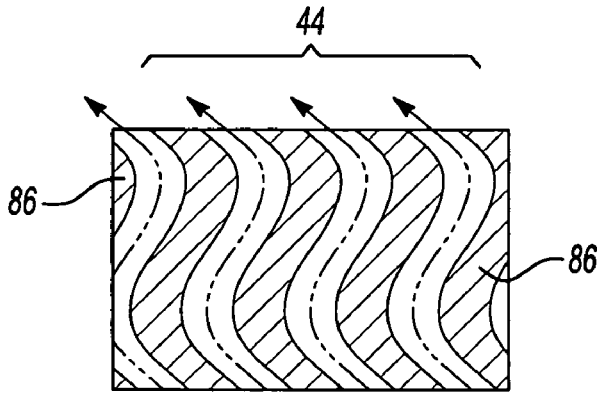
FIG. 6D is a schematic view of another pedestal according to this invention.
Figure 6E:
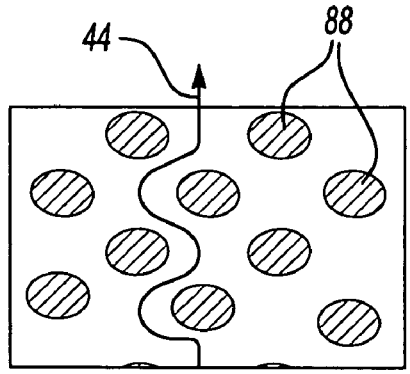
FIG. 6E is a schematic view of another pedestal according to this invention.

Referring to FIGS. 6A-6E, although a cylindrical pedestal 62 is illustrated as populating the cavities 40,42,54, and 55, other shapes are also within the contemplation of this invention. FIG. 6A illustrates rectangular pedestals 80 that are placed to provide and create a tortuous path for cooling air flow 44. FIG. 6B illustrates a plurality of chevron shaped pedestals 82 arranged between walls 83 to create the desired turbulence in the cooling air flow 44. FIG. 6C includes rectangular shaped pedestals 84 positioned in an alternating arrangement to disrupt air flow 44. FIG. 6D illustrates a plurality of wavy walled pedestals 86 that create a tortuous path for cooling air flow. FIG. 6E includes a plurality of oval shaped pedestals 88 that are alternately arranged to provide the desired tortuous path for the cooling air flow 44. The examples illustrated are not exhaustive and other shapes an configuration are within the contemplation of this invention to accomplish application specific cooling properties.

The seal segment 22 is constructed utilizing a lost core molding operation were a core is provided having a desired configuration that would provide the desired cavity structure. The core is over-molded with a material forming the segment. The material may include metal, composite structures or a worker versed in the art knows ceramic structures. The core is then removed from the seal segment 22 to provide the desired internal configuration of the cavities 40,42 and 54. As should be appreciated, many different construction and molding techniques for forming the seal segment 22 are within the contemplation of this invention.

Figure 7:
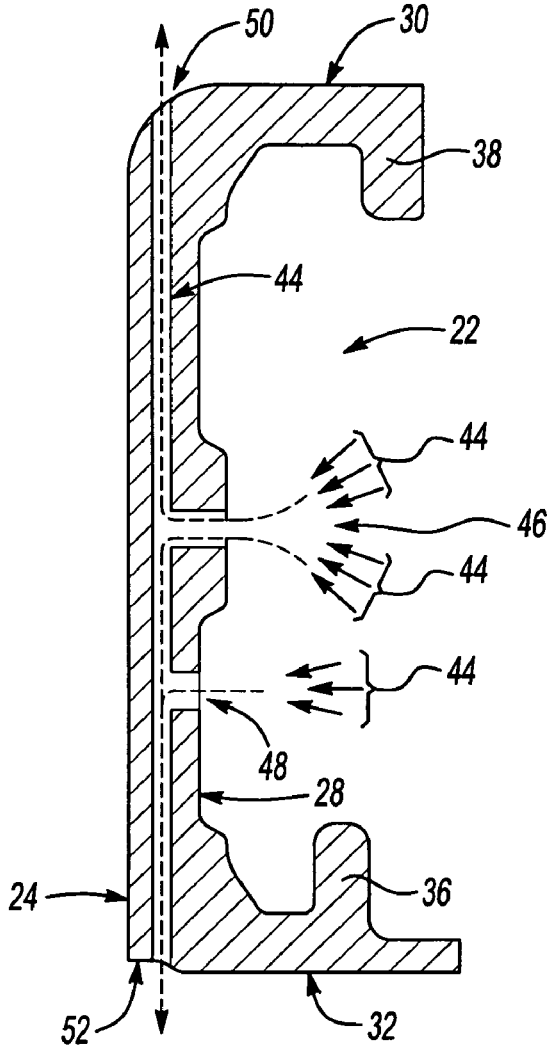
FIG. 7 is a sectional side view of a sealing segment of this invention.

Referring to FIG. 7, the seal segment 22 is shown in cross-section and includes the plurality of inlets 46 in a generally midpoint location between the leading edge 50 and the trailing edge 52. The midway location of the plurality of inlets 46 corresponds with a region of greatest heating of the seal segment 22. The hot side 24 of the seal segment 22 is hottest at the location that is offset slightly toward the leading edge 50 from a location substantially midway between the leading edge 50 and the trailing edge 52. The location of the plurality of inlets 46 corresponds with the greatest heated region on the surface of the hot side 24. From the inlet cooling air flow 44 is divided between the leading edge cavity 42 and the trailing edge cavity 40. The cooling air flow 44 flows toward the outlets 50, 52 at each of the leading and trailing edges 30,32. The re-supply openings 48 add additional cooling air flow 44 to a location spaced apart from the plurality of inlets 46.

Figure 8:
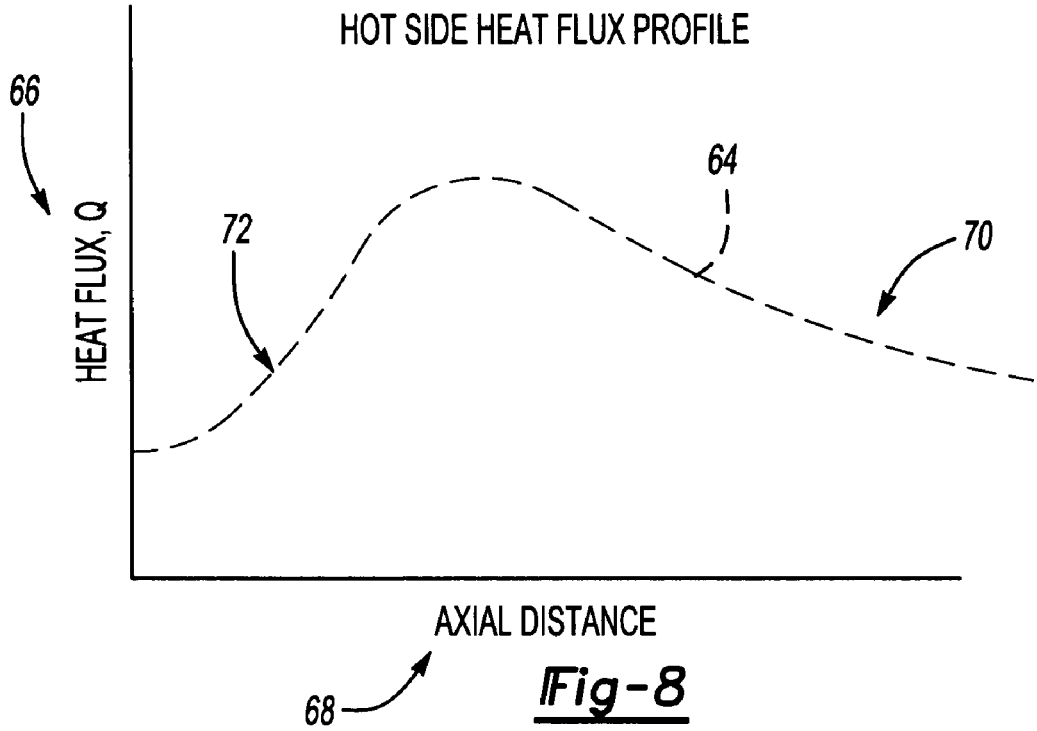
FIG. 8 is a graph illustrating a relationship between heat input and axial distance from a leading edge.
Figure 9:
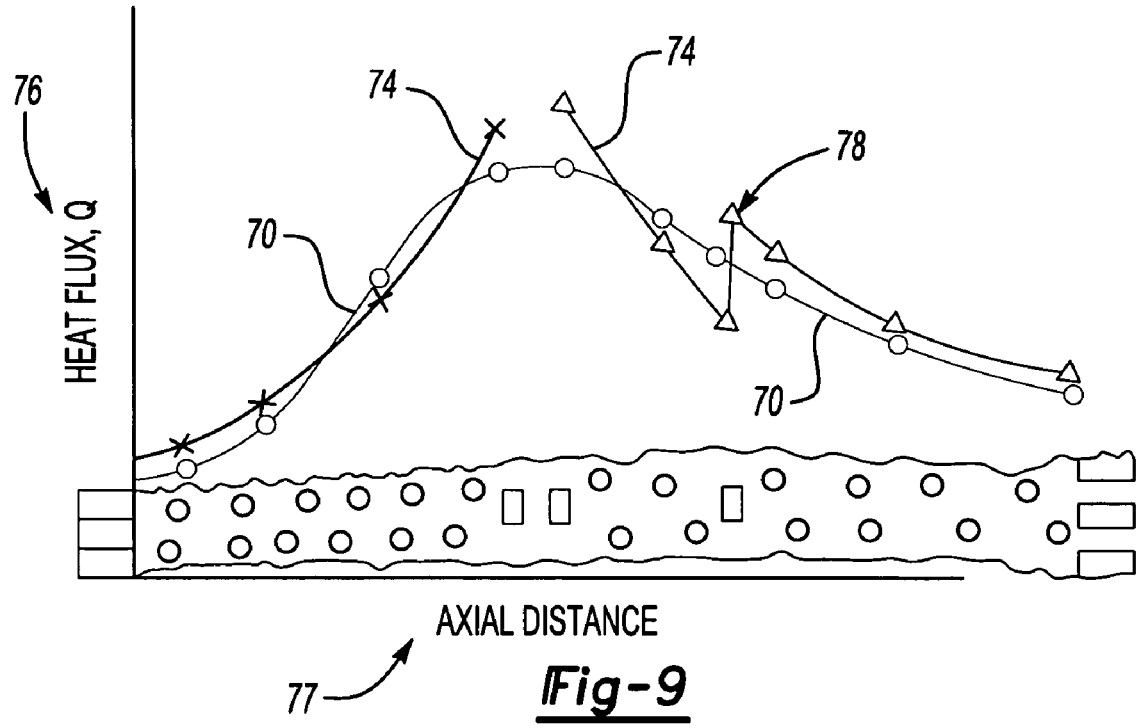
FIG. 9 is a graph illustrating a relationship between heat input and cooling capacity at an axial distance from the leading edge.

Referring to FIGS. 8 and 9, to provide the desired cooling of the seal segment 22 and thereby a constant temperature of the hot side 24, the amount of heat removed by the cooling air flow 44 is substantially the same as the amount of heat input from the gas flow 12. FIG. 8 is a graph including a line 64 that shows a relationship between heat input into the seal segment 22 relative to an axial location 68 from the leading edge 30. Heat input is greatest at a point slightly forward of a midway point of the seal segment 22. The quantity of heat steadily declines toward the leading edge, as shown by arrow 72 and toward the trailing edges, shown by arrow 70. Cooling air flow 44 initially entering the cavities 40,42 has the greatest heat absorption capacity corresponding with the hottest point on the seal segment 22. As the cooling air flow 44 moves away from the inlets 46, it increases temperature, and therefore has a reduced heat absorption capacity.

Referring to FIG. 9, a graph is shown that relates heat absorption capacity of the cooing air 44 at an axial distance with the heat input into the seal segment 22. FIG. 9 illustrates the relationship between heat input 76 an axial distance 77 from the leading edge. Lines 70 represent heat input into the seal segment 22 at the axial location. Lines 74 represent the heat absorption capacity of the cooling air flow 44 at the axial location. As appreciated at the inlet location the heat absorption capacity is greatest and corresponds with the maximum amount of heat input into the seal segment 22. Heat input 70 and heat absorption capacity decreases with axial distance away from the hot points. The seal segment 22 includes heat absorption capacity that is matched to the heat input to maintain a desired temperature of the hot side 24.

Further, a small peak indicated at 78 represents a location of the re-supply openings 48. The re-supply openings 48 provide additional cooling air flow 44 required to maintain and balance a relationship between cooling capacity and heat input into the seal segment 22. The leading edge cavity 42 and the trailing edge cavity 40 provide a cooling potential that matches the external heat loads on the seal segment 22. The pedestal geometries in each of the cavities 40,42 are adjusted to substantially match the external heat loads on the hot side 24 for any axial location. The specific location is determined according to application specific requirements to provide the desired cooling capacity in local areas of the seal segment.

The seal segment 22 of this invention provides improved heat removal properties by directing incoming cooling air flow 44 to the region of greatest heating and by generating turbulent flow over increased cavity surface area provided by the plurality of pedestals 62. The resulting seal segment 22 provides improved cooling without a corresponding increase in cooling air flow requirements.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A blade outer air seal assembly for a turbine engine comprising:

a plurality of interfiting blade outer air seal segments each including a leading edge, a trailing edge, two axial edges, a back side and a hot side exposed to combustion gases, wherein each of said plurality of interfiting blade air seal segments includes a cavity including a top surface and a bottom surface, said top surface disposed on a side opposite said back side, and said bottom surface comprising a side opposite said hot side exposed to combustion gases;

a plurality of outlets disposed at said leading edge and said trailing edge for exhausting cooling airflow into the flow of combustion gases; and a plurality of pedestals extending from said top surface and said bottom surface for creating turbulent cooling air flow through said cavity.

2. The assembly as recited in claim 1, wherein said plurality of inlet openings are arranged in a row substantially parallel with said leading edge and said trailing edge.

3. The assembly as recited in claim 2, wherein said plurality of inlet openings are arranged substantially midway between said leading edge and said trailing edge.

4. The assembly as recited in claim 2, wherein said cavity includes a divider for separating cooling air flow from said inlet holes such that a portion of said cooling air flow flows toward said leading edge and another portion flows toward said trailing edge.

5. The assembly as recited in claim 4, wherein said cavity comprises a leading edge cavity and a trailing edge cavity isolated from each other by said divider, wherein a cooling capacity of said cooling air flow corresponds to heat input such that said seal assembly maintains a desired surface temperature.

6. The assembly as recited in claim 2, wherein said plurality of pedestals comprises a first plurality of pedestals arranged between said divider and said leading edge and second plurality of pedestals arranged between said divider and said trailing edge.

7. The assembly as recited in claim 6, including a third and a forth plurality of pedestals disposed along respective axial edges.

8. The assembly as recited in claim 7, wherein each of said third and fourth plurality of pedestals are isolated from any other of said pluralities of pedestals by an axial divider.

9. The assembly as recited in claim 1, wherein each of said plurality of pedestals comprises a cylindrical member.

10. The assembly as recited in claim 1, wherein each of said plurality of pedestals comprises a chevron shaped structure.

11. The assembly as recited in claim 1, wherein each of said plurality of pedestals comprises a rectangular structure.

12. The assembly as recited in claim 1, wherein each of said plurality of pedestals comprises an oval-shaped structure.

13. The assembly as recited in claim 1, wherein said plurality or pedestals comprise a tortuous path for cooling air flow.

14. A turbine blade shroud assembly for a turbine engine comprising:

a plurality of interfitting blade outer air seal segments, each of said plurality of interfitting blade outer air seal assemblies a leading edge, a trailing edge, axial edges, and a cavity including a top surface and a bottom surface, said top surface comprising a side opposite a back side, and said bottom surface comprising a side opposite a hot side exposed to combustion gases, said cavity includes a plurality of inlet openings disposed along said back side between said leading and trailing edges; wherein said cavity comprises a leading edge cavity and a trailing edge cavity separated by a divider and a plurality of pedestals extending between said top surface and said bottom surface for creating turbulent cooling air flow through said cavity.

15. The assembly as recited in claim 14, including an axial joint between adjacent ones of said plurality of interfitting blade outer air seal segments.

16. The assembly as recited in claim 14, wherein said inlet openings are disposed to inject cooling air flow at an axial location with a greatest heat generation.

17. The assembly as recited in claim 14, including axial cavities disposed along said axial edges that are separate from said cavity.

18. A blade outer air seal segment comprising:

a leading edge;

a trailing edge;

a cool side exposed to a source of cooling air;

a hot side exposed to hot fluid flow; and a main cavity including a top surface and a bottom surface, said top surface comprising a side opposite said cool side, and said bottom surface comprising a side opposite said hot side, wherein said main cavity is divided into a trailing edge cavity and a leading edge cavity by a divider that divides cooling air flow between said leading edge cavity and said trailing edge cavity.

19. The blade outer air seal segment recited in claim 18, including a plurality of cooling air inlets disposed to communicate air into said cavity proximate said divider.

20. The blade outer air seal segment recited in claim 18, wherein said divider comprises a castellated wall between said trailing edge cavity and said leading edge cavity, and adjacent ones of said plurality of cooling air inlets communicate air to a different one of said leading edge cavity and said trailing edge cavity.

21. The blade outer air seal segment recited in claim 18, including a plurality of pedestals extending between said top surface and said bottom surface of said cavity.

22. The blade outer air seal segment recited in claim 18, including first and second lateral edges extending between said leading edge and said trailing edge and at least one lateral cavity disposed at each of the first and second lateral edges supplied with cooling air separate from said main cavity.

* * * * *

UNITED STATES PATENT AND TRADEMARK OFFICE

CERTIFICATE OF CORRECTION

PATENT NO. : 7,306,424 B2
APPLICATION NO. : 11/025172
DATED : December 11, 2007
INVENTOR(S) : Romanov et al.

It is certified that error appears in the above-identified patent and that said Letters Patent is hereby corrected as shown below:

Claim 14, Column 6, line 49: insert --comprising-- between "assemblies" and the first occurence of "a"

Signed and Sealed this

Twenty Second Day of April, 2008

JON W. DUDAS
*Director of the United States Patent and Trademark Office*